US006315082B2

(12) United States Patent
Hikita

(10) Patent No.: US 6,315,082 B2
(45) Date of Patent: Nov. 13, 2001

(54) ELEVATOR GROUP SUPERVISORY CONTROL SYSTEM EMPLOYING SCANNING FOR SIMPLIFIED PERFORMANCE SIMULATION

(75) Inventor: Shiro Hikita, Tokyo (JP)

(73) Assignee: Mitsubishi Denki Kabusahiki Kaisha, Tokyo (JP)

( * ) Notice: Subject to any disclaimer, the term of this patent is extended or adjusted under 35 U.S.C. 154(b) by 0 days.

(21) Appl. No.: 09/809,210

(22) Filed: Mar. 16, 2001

Related U.S. Application Data

(63) Continuation of application No. PCT/JP99/05818, filed on Oct. 21, 1999.

(51) Int. Cl.[7] ..... B66B 1/16
(52) U.S. Cl. ..... 187/382; 187/247
(58) Field of Search ..... 187/380, 381, 187/382, 384, 387, 247

(56) References Cited

U.S. PATENT DOCUMENTS

| | | | | |
|---|---|---|---|---|
| 4,846,311 | | 7/1989 | Tahngavelu . | |
| 5,022,498 | * | 6/1991 | Sasaki et al. | 187/127 |
| 5,229,559 | * | 7/1993 | Siikonen et al. | 187/124 |
| 5,239,141 | * | 8/1993 | Tobita et al. | 187/127 |
| 5,306,878 | * | 4/1994 | Kubo | 187/127 |
| 5,412,163 | * | 5/1995 | Tsuji | 187/382 |
| 5,459,665 | * | 10/1995 | Hikita et al. | 187/393 |
| 5,612,519 | * | 3/1997 | Chenais | 187/382 |

FOREIGN PATENT DOCUMENTS

| | | |
|---|---|---|
| 2 293 365 | 3/1996 | (GB) . |
| 7-61723 | 3/1995 | (JP) . |
| 2-261785 | 6/1997 | (JP) . |
| 10-236742 | 9/1998 | (JP) . |

OTHER PUBLICATIONS

U.S. application No. 09/727,786, Hikita et al., filed Dec. 4, 2000.

* cited by examiner

*Primary Examiner*—Jonathan Salata
(74) *Attorney, Agent, or Firm*—Leydig, Voit & Mayer, Ltd.

(57) ABSTRACT

A rule base storing control rule sets simulates the behavior of each car of an elevator system in real time by assigning scanning to each car which is caused to run until the direction of running is reversed, while applying a specified rule set in the rule base to the current traffic condition, and predicts group supervisory control performance upon application of the specified rule set. In response to the results of performance prediction, an optimal rule set is selected and a real time simulation can be carried out during a group supervisory control operation, so that group supervisory control can be performed on multiple elevator cars while applying the optimal rule set at all times, thus providing excellent service.

2 Claims, 5 Drawing Sheets

ELEVATOR GROUP SUPERVISORY CONTROL SYSTEM EMPLOYING SCANNING FOR SIMPLIFIED PERFORMANCE SIMULATION

CROSS REFERENCE TO RELATED APPLICATION

This is a continuation of International Application PCT/JP99/05818, with an international filing date of Oct. 21, 1999, the content of which is hereby incorporated by reference into the present application.

TECHNICAL FIELD

This invention relates to an elevator group supervisory control system capable of efficiently controlling a plurality of elevators as a group or groups.

BACKGROUND ART

In general, group supervisory control is effected in a system in which a plurality of elevators are operating. In such a system, a variety of types of controls are performed including a car assignment control in which an optimally assigned car is selected in response to a hall call occurring at a certain hall, a deadhead or forwarding operation in which some cars are controlled to travel to a specified floor or floors independently of the occurrence of a hall call particularly in peak periods, division of service zones, etc. Recently, various methods have been proposed for predicting the results of group supervisory control, i.e., group supervisory control performance such as waiting times and the like, and accordingly setting control parameters, as disclosed in the Japanese Patent No. 2664766, Japanese Patent Application Laid-Open No. Hei 7-61723, etc, In the above-mentioned two prior art references, there are described systems which, using a neural net which receives, as its inputs, traffic demand parameters and evaluating operation parameters for call assignment and generates, as its output, a group supervisory control performance, evaluates the output result of the neural net to set optimal evaluating operation parameter accordingly.

However, with the above-mentioned prior art references, what is set based on the results of the group supervisory control performance prediction is limited to a single evaluation operation parameter for the call assignment, and hence there is a limitation to improvements in transportation performance due solely to the operation or calculation which uses such a single evaluation operation parameter for the call assignment. That is, it is necessary to use a variety of rules such as deadhead, zone division, etc., depending upon traffic conditions, and thus no really excellent group supervisory control performance could be obtained.

Moreover, though a neutral net has merit in that its operation of calculation accuracy can be improved through learning, it has a demerit in that it takes much time until it reaches a practical level of operation or calculation accuracy.

In the systems disclosed in the above-mentioned prior art references, it is impossible to obtain an expected level of group supervisory control performance unless the neural net has been subjected to learning in advance at the factory. In addition, the group supervisory control performance prediction accuracy by the neural net decreases greatly when traffic demand changes rapidly due to a change in the tenants in a building.

Moreover, a method of calculating a group supervisory control performance value or gain at a constant traffic demand by means of probability operations is described in a teaching material of Japan Society of Mechanical Engineers 517th Meeting, entitled "Theory and Practical State of Elevator Group Supervisory Control Systems". According to this method, however, only an average value of waiting times is calculated for instance, and other group supervisory control performance indices such as the maximum value and distribution of waiting times, the number of non-stop passages of fully loaded cars, the number of cars which left off passengers, etc. cannot be calculated. Therefore, it is impossible to change control parameters while referring to predicted values of various group supervisory control performance indices.

Further, when a group supervisory control system is developed, a group supervisory control simulation is usually carried out to understand its performance. In such a group supervisory control simulation, individual passenger data are input, and the same control operations as those performed in the product are done for each hall call made by a passenger, thereby allocating a car to the call. In general, car behaviors are imitated on the computer according to the call assignment, whereby the performance of the system, i.e., the group supervisory control performance, is output. Since the same control operations as those in this simulation product can be done in principle, the prediction accuracy of the group supervisory control performance is very high.

Ideally, it is desired that the group supervisory control simulation used in this product development process be built into a group supervisory control system without any change, and the group supervisory control performance of the system be predicted through simulations to thereby determine an optimal control method. If this could be achieved, the problems in the method of using the neural net and the probability operations as referred to above would be solved.

However, this means that the same operations are carried out a plurality of times while the actual group supervisory control is being effected. Therefore, it is realistically difficult to complete the simulation within real time by means of a microcomputer generally used in an actual group supervisory control system. That is, a method is sought by which it is possible to complete operations or calculations within real time to predict the group supervisory control performance with high accuracy.

The present invention is intended to solve the above-mentioned problems in the prior art, and provide an elevator group supervisory control system which provides a real time simulation during group supervisory control, select an optimal rule set at all times, and perform excellent group supervisory control.

DISCLOSURE OF THE INVENTION

An elevator group supervisory control system according to the present invention includes: in the elevator group supervisory control system for controlling a plurality of elevators as a group, a traffic condition detecting section for detecting a current traffic condition of the plurality of elevators; a rule base for storing a plurality of control rule sets required for group supervisory control; a real time simulating section for simulating the behavior of each car in real time by assigning scanning to each car which is caused to run until the direction of running thereof is reversed while applying a specified rule set in the rule base to the current traffic condition, and for predicting group supervisory control performance which is obtained upon application of the specified rule set; a rule set selecting section for selecting an optimal rule set in response to the results of prediction of the real time simulating section; and an operation control section for controlling an operation of each car based on the rule set selected by the rule set selecting section.

Moreover, the above-mentioned real time simulating section is characterized by comprising: a scanning assignment determining section for determining timing at which each car is caused to run and a response floor during simulation, and for performing scanning assignment to each car; a stop determining section for performing a stop determination for each car during scanning running thereof; a getting-on and getting-off processing section for performing getting-on and getting-off processing upon stoppage of each car; a statistical processing section for performing statistical processing such as waiting time distribution after completion of the simulation; and a time control section for controlling simulation time.

THE BEST MODE FOR IMPLEMENTING THE INVENTION

Before describing an embodiment of the present invention, reference is had to the concept of a simulation carried out in the present invention.

The control in a group supervisory operation for elevators roughly includes the following two kinds of controls:

1) Call assignment control (selection of a response car to a hall call generated)
2) Deadhead/service floor limitation, etc. (forwarding an empty car to a main floor at starting times, etc.)

In the above controls, item 1) above is a basic control done all day long, with waiting times being usually made as the most important index. Item 2) above is a special operation such as a starting time operation, a lunch time operation, etc., done according to a change in traffic demand.

Although item 1) above is an important control factor and has some parameters, but a change in the parameters thereof exerts a less influence on the group supervisory control performance in comparison with item 2) above.

Thus, the present invention employs a method which is capable of simplifying call assignment operations or calculations in item 1) above but simulating deadhead/service floor limitations, etc., in item 2) above in a detailed manner. As a result, it is possible to reduce the operation or calculation procedures required in item 1) above, and hence complete a simulation thereof in a short period of time.

To achieve the above-mentioned, the concept of a scanning assignment is introduced herein. Here, note that the term "scanning" means a series of operations from the commencement of running of a car to reversing of the direction of running thereof. For example, when a certain car is running in the order of 1F (1st floor) →3F→7F→9F→10F→8F→6F→3F→1F→2F→4F→6F→9F→10F, scannings are represented as follows:

The first scanning: 1F→3F→7F→9F→10F

The second scanning: 10F→8F→6F→3F→1F

The third scanning: 1F→2F→4F→6F→9F→10F

Figure 5:
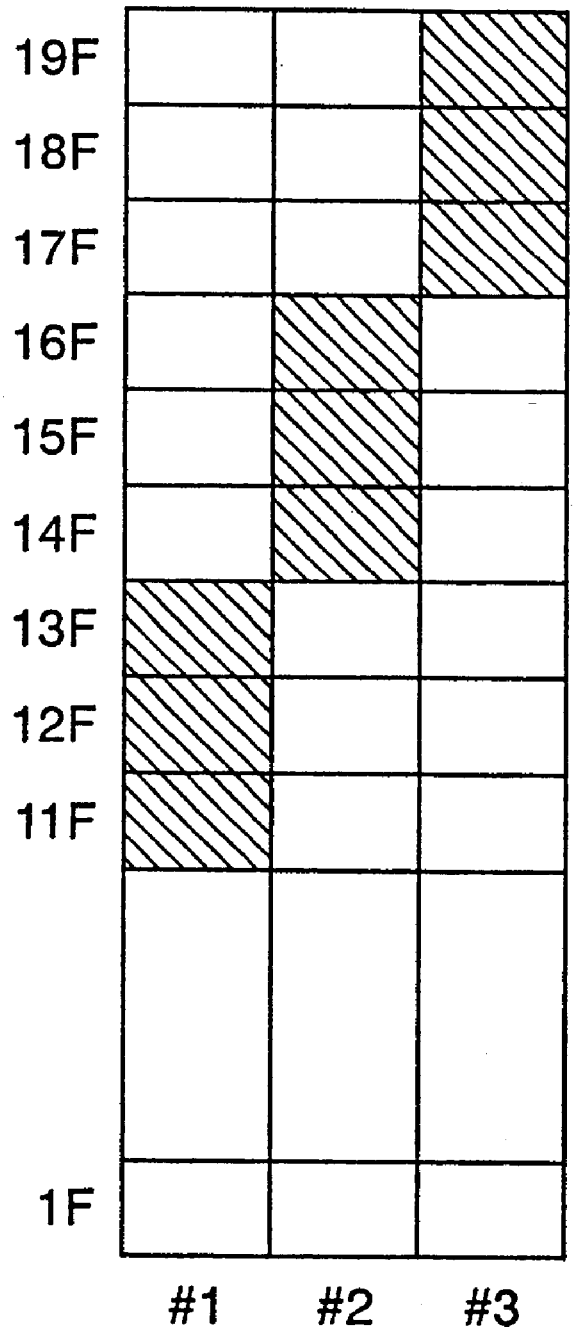
FIG. 5 is an explanatory view for explaining a scanning assignment.

Now, let us consider, as an example of service floor limitations, the case in which 1F is a main floor and has hall destination buttons set up therein, and a destination zone (service zone) from 1F of each car is divided into three sub-zones, as shown in an example of FIG. 5. The number of cars in this case shown in FIG. 5 is three, and they are designated at #1 through #3.

The destination zone of each car is not fixed but varied as necessary, and thus with the same car, it serves in a destination zone between 11F or 13F from 1F in one case, and also serves in another destination zone between 14F or 16F from 1F in another case. Such control is called "assignment of cars according to destination floors", and it is very effective at starting times. When such control is carried out, the group supervisory control performance is greatly influenced by the number of sub-zones into which a service zone is divided.

Accordingly, the number of division herein is set to two or three. A simulation is performed for each case, and the effect thereof is verified, so that an optimal number of division is adopted.

In the case where three divisions are made as shown in FIG. 5, there exist three kinds of running (scanning) in an upward or ascending direction (hereinafter referred to as "UP direction"). There is one kind of running (scanning) in a downward or descending direction (hereinafter referred to as "DN direction"). Specifically, the scannings in the upward direction UP include a first UP scanning (1F→11F, 12F, 13F, i.e., upward movement to 11F through 13F), a second UP scanning (1F→14F, 15F, 16F, i.e., upward movement to 14F through 16F), and a third UP scanning (1F→17F, 18F, 19F, i.e., upward movement to 17F through 19F), and the scanning in the DN direction includes a movement in the downward direction.

Upon simulating, traffic demands per unit time between respective floors are set in advance. Each car is assumed to be in the first floor (1F) at the time when simulation is started. First, a car #1 is taken, and one of three kinds of scannings is assigned to the car #1. The scanning assignment is determined based on the largest of destination demands for respective floors from 1F and call demands on each floor.

The car to which the scanning thus determined is assigned is caused to run in the scanning for which it should serve. A running time of the car can be calculated uniquely from the floor height, the running speed of the car, etc. The number of passengers who gets on and off the car on each floor during the car is running while scanning is determined using the probability of call generation at each floor and random numbers, of which former is calculated from traffic demands. When passengers get on the car, a waiting time for the passengers is pseudo calculated from the point in time at which other passengers got on the car at that floor the last time.

With respect to the floor at which the passengers has got on the car, the traffic demand at that floor is calculated by subtracting the number of those passengers from the previously determined traffic demand. In this manner, it is possible to calculate through simulation the times of running, getting on and off, and waiting for the car to which the scanning is assigned.

The above calculations are continued until the assigned scanning is finished, and thereafter, the following car is taken out and scanning assignment and running are calculated in the same procedures. Taking out the following car is effected such that the car having the shortest scanning finish time is selected and taken out. Scanning assignment is made such that the scanning with the highest traffic demand at that point in time is assigned. In addition, in cases where it is necessary to deadhead or forward empty cars to the first floor (1F) at starting times or the like, traffic demands at respective floors from 1F are incorporated. Concretely, the probability of call generation from 1F is increased.

In this manner, it is possible to calculate the group supervisory control performance with relatively high accuracy when the above-mentioned destination zone is divided into three sub-zones with an empty car being deadheaded or forwarded to 1F, although call assignment procedures in the actual group supervisory control are omitted.

In the following, concrete embodiments for achieving the above-mentioned concept will be described while referring to the accompanying drawings.

Figure 1:
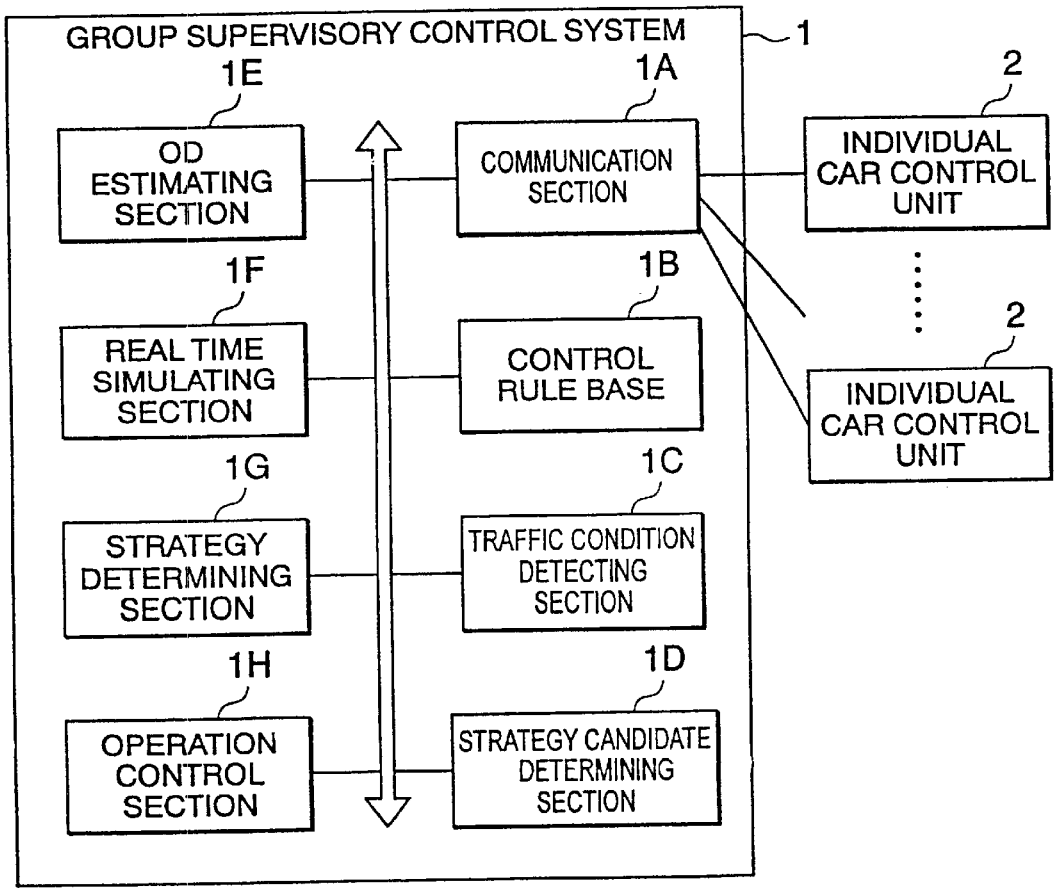
FIG. 1 is a block diagram which shows the construction of an elevator group supervisory control system according to the present invention.

FIG. 1 is a block diagram illustrating the construction of an elevator group supervisory control system according to the present invention.

In FIG. 1, 1 designates a group supervisory control system for controlling a plurality of elevators as a group or groups, and 2 designates a plurality of individual car control units each controlling a corresponding elevator.

The group supervisory control system 1 includes a communication section 1A for communicating with the individual car control units 2, a control rule base 1B for storing a plurality of control rule sets such as zone-separated car assignment rules according to deadhead, zone-division and assignment evaluation formulae, etc., required for group supervisory control, a traffic condition detecting section 1C, a strategy candidate determining section 1D for determining a strategy candidate of specific rule sets to be adopted from the control rule base 1B based on the result of detection of the traffic condition detecting section 1C, an OD estimating section 1E for estimating ODs (Origins and Destinations: getting-on floors and getting-off floors) occurring in a building based on the result of detection of the traffic condition detecting section 1C, a real time simulating section 1F for performing, based on the result of estimation of the OD estimating section 1E, simulations in real time with the respective rule sets which are determined by the strategy candidate determining section 1D, to thereby predict group supervisory control performance, a strategy determining section 1G for determining an optimal rule set based on the result of prediction of the real time simulating section 1F, and an operation control section 1H for performing overall operational control on the respective cars based on the optimal rule set determined by the strategy determining section 1G. The above-mentioned respective components of the group supervisory control system 1 are implemented and configured by software executed by a computer.

Figure 2:
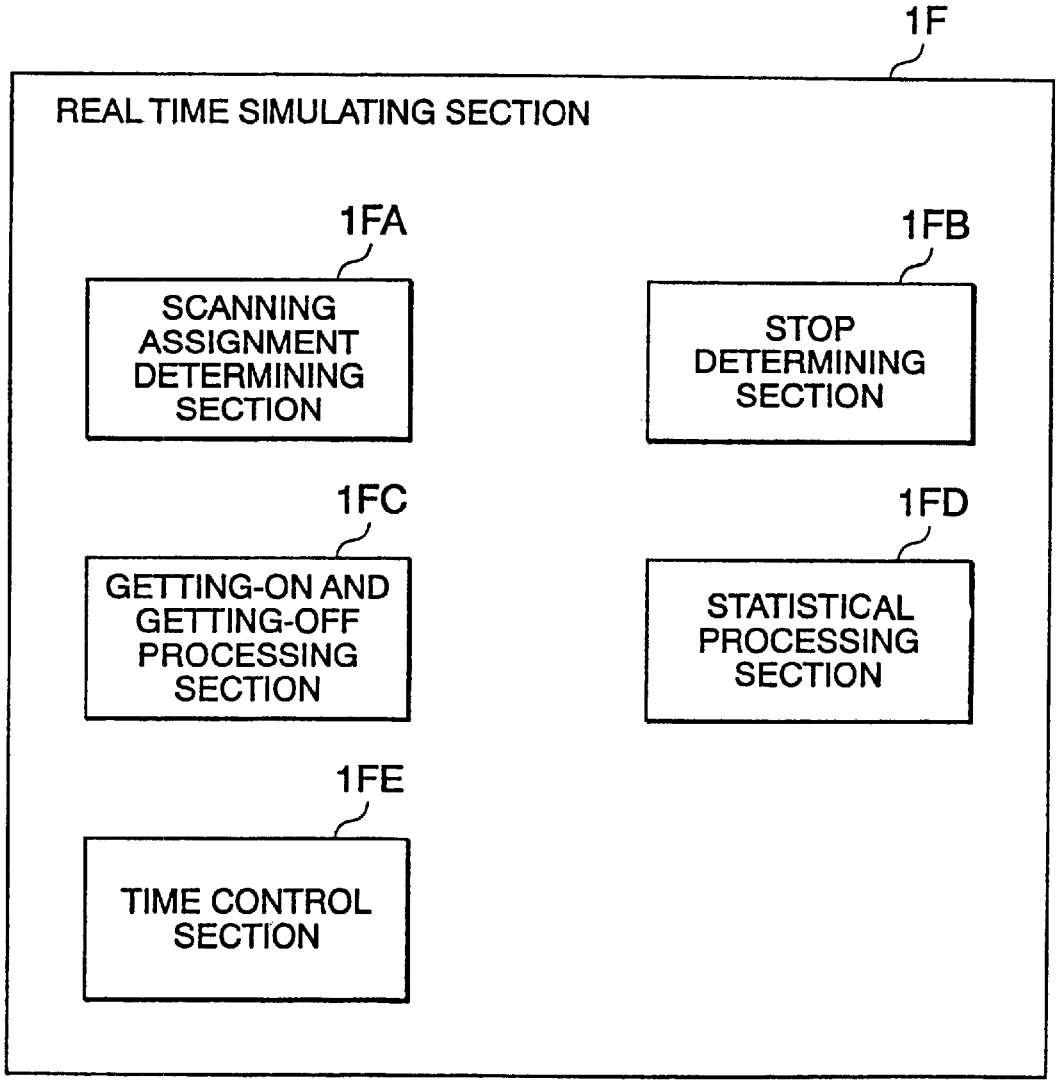
FIG. 2 illustrates a detailed configuration of a real time simulating section shown in FIG. 1.

FIG. 2 is a block diagram illustrating a detailed construction of real time simulating section 1F in the elevator group supervisory control system 1 shown in FIG. 1.

As shown in FIG. 2, the real time simulating section 1F includes a scanning assignment determining section 1FA for determining the scanning assignment of each car in the simulation, a stop determining section 1FB for making a stop determination for each car, an getting-on and getting-off processing section 1FC for performing getting-on and getting-off processing, a statistical processing section 1FD for performing statistical processing to thereby an average value and distribution of waiting times, etc., and a time control section 1FE for controlling time in simulation.

Next, reference will be had to the operation of this embodiment while referring to the accompanying drawings.

Figure 3:
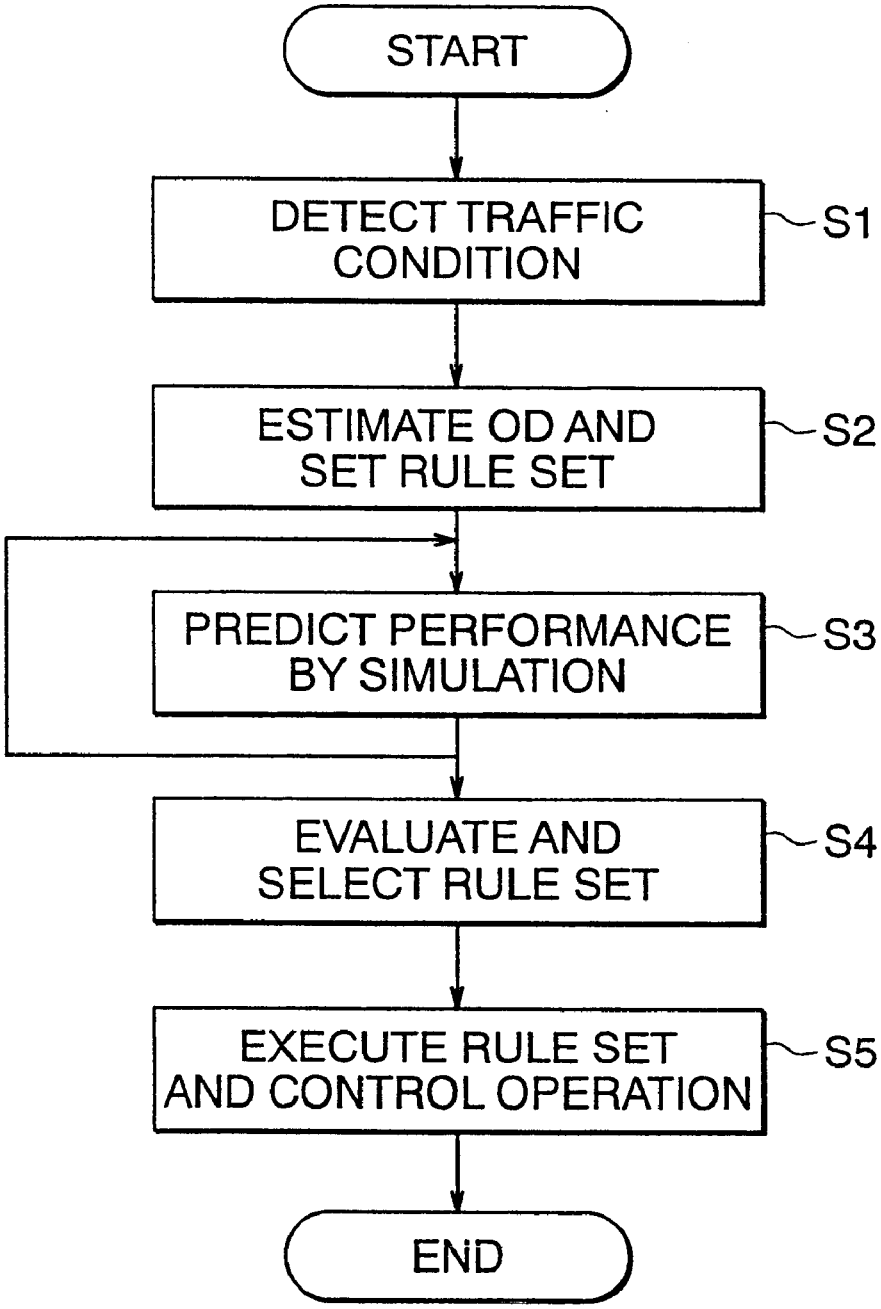
FIG. 3 is a flow chart showing a schematic operation of a control procedure of a group supervisory control apparatus according to an embodiment of the present invention.
Figure 4:
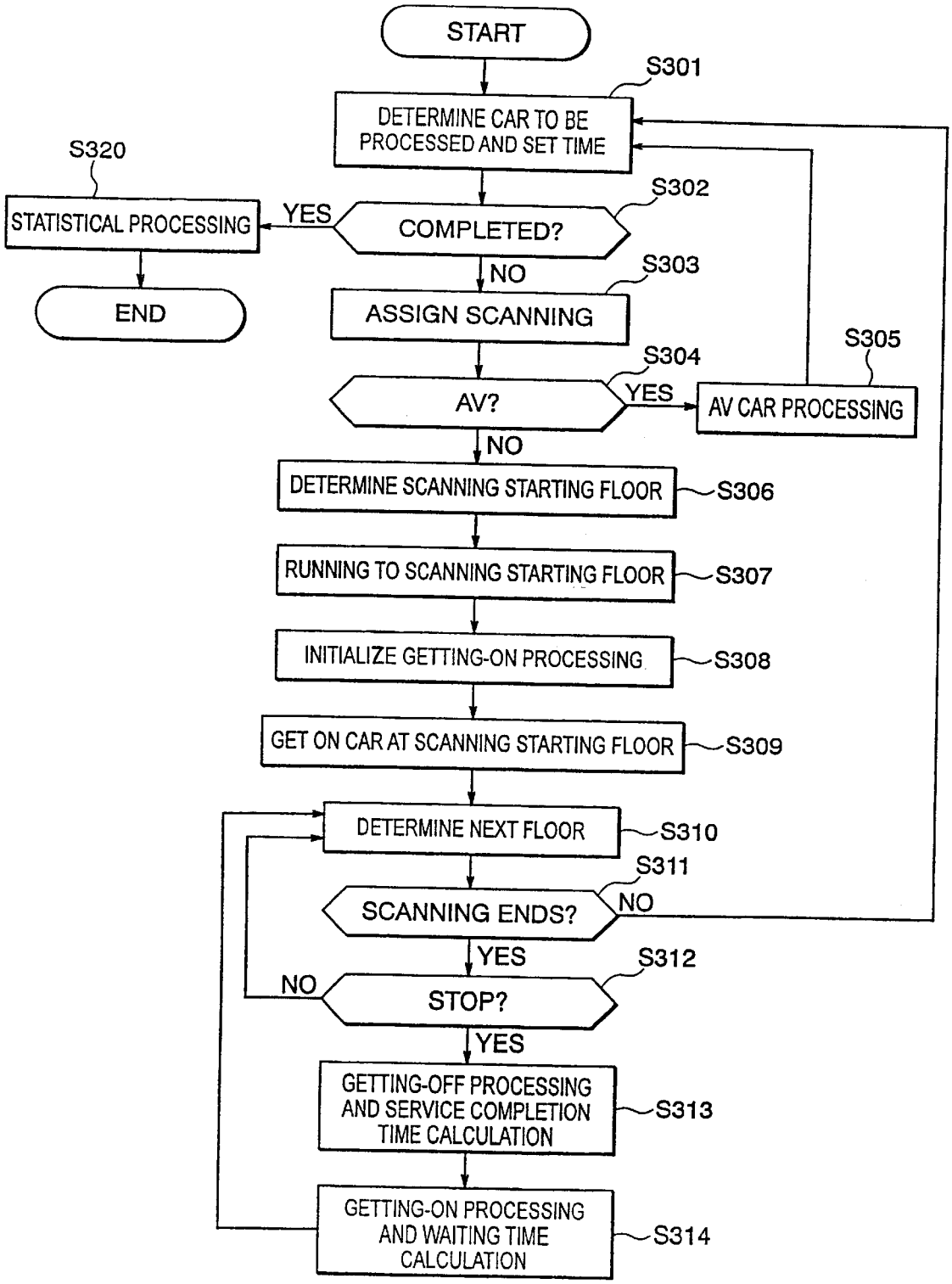
FIG. 4 is a flow chart showing a real time simulation procedure the embodiment of the present invention.

FIG. 3 is a flow chart illustrating a schematic operation in the control procedures of the group supervisory control system 1 according to this embodiment; FIG. 4 is a flow chart illustrating the control procedures of the real time simulating section 1F; and FIG. 5 is an explanatory view for explaining the operation of the scanning assignment determining section 1FA.

First, the schematic operation in the control procedures of the group supervisory control system 1 will be described with reference to FIG. 3.

In step S1, the behavior of each car is observed by the traffic condition detecting section 1C through the communication section 1A, and a traffic condition such as, for example, the number of passengers getting on and off each car at each floor is detected. For instance, the data describing this traffic condition uses integrated values per unit time (for instance, five minutes) of the number of passengers getting on and off at each floor.

Then, in step S2, an OD in the building is estimated based on the traffic condition data, which is detected by the traffic condition detecting section 1C, by means of the OD estimating section 1E. Or, such an OD estimated value may be obtained using a well-known method. The candidate of groups of the rule sets to be applied are determined and set from the control rule base 1B based on the result of estimation of the OD estimating section 1E by means of the strategy candidate determining section 1D.

In the procedure of this step S2, as for the method of estimating the OD from the number of passengers getting on and off at each floor, some methods such as one using a neural net, etc., have conventionally been proposed. Also, it is considered that a method using meta-rules may be adopted for determining the candidate of the rule set group to be applied. For instance, in the case where it is determined that the estimated OD corresponds to starting times and hall destination floor registration buttons are provided on a main floor, attention is recently directed to a method in which destination floors are divided into a plurality of service zones, and cars in charge are assigned in real time to each of the thus divided service zones, the method being recognized as an effective and feasible means for improving the transportation capacity and efficiency. In this example, different rule sets are required depending upon the manner of dividing the service zones, i.e., whether a service zone is divided into three or four sub-zones, and which one is more effective than the other varies depending upon the traffic demand.

Subsequently in step S3, the group supervisory control performance is predicted by the real time simulating section 1F while using the concept of scanning assignment as referred to above by way of example. Details of this procedure are described later. The procedure of this step S3 is done to each rule set prepared in step S2.

In step S4, the results of the performance prediction (an average value, a maximum value, distribution of the service completion times and waiting times) carried out to each rule set by the real time simulating section 1F are evaluated by the strategy determining section 1G, and the best of them is selected.

In step S5, the rule set selected by the strategy determining section 1G in step S4 is executed to transmit various instructions, limiting conditions and the car operation methods to the operation control section 1H, whereby the operation control section 1 controls operations of the cars based on the transmitted instructions, etc. The foregoing is an explanation of the schematic operation of this embodiment.

Now, the details of the simulation procedure carried out in step S3 of FIG. 3 will be described while referring to FIG. 4 and FIG. 5.

FIG. 4 shows the procedures of a simulation mainly performed by the real time simulating section 1F, and FIG. 5 is a view showing one example of the simulation.

First, in step S301, the car which is to be processed next is taken out. Here, note that each car has a processing time point (simulation time point), which is indicated at T2(cage), in which "cage" is a car number. In the simulation process, the car having the shortest processing time is taken out. In the initial state, cars may be taken out in the order of the car number.

In step S302, it is determined whether the simulation has been finished. If the processing time point T2(cage) of each car exceeds a preset time, the processing is finished, and statistical processing in step S320 is done. Otherwise, the procedures in step S303 and thereafter are executed. Here, note that the above-mentioned steps S301 and S302 are carried out by the time control section 1FE.

In step S303, the scanning assignment determining section 1FA performs a scanning assignment for the designated car. Here, let us take, as an example, the case in which, as shown in FIG. 5, a service zone from 1F of three elevators is divided into three sub-zones, like the blackened portions of FIG. 5, at starting times. In this case, three kinds of services are considered for the UP side scanning. In this step S303, when a car changes to running, it is determined which one of the first UP scanning through the third UP scanning is assigned to the car.

Here, the car is assigned to that one of the scannings which has the stochastically highest demand among the scannings having three kinds of services. Concretely, the expected number of passengers generated at each scanning is first calculated by the following equation (1):

$$\text{(the expected number of passengers generated at scanning m at time } t) = \Sigma_i \Sigma_j \text{od-pass-rate}(i,j) \times M_{13}OD_{13}\text{Map}\ (m,i,j) \times tx(i,j,t) \quad (1)$$

where od-pass-rate(i,j): the expected number of passengers per unit time from i floor to j floor;

M_OD_Map(m,i,j): 1 when the car serves from i floor to j floor at scanning m, and 0 when the car does not serve;

tx(i,j,t): a period of time from the moment when the car last served with respect to a movement from i floor to j floor to time t.

Subsequently, the call generation probability at each scanning is calculated from the expected number of passengers generated, which is calculated by equation (1) above, using the following equation (2):

$$P(m,t) = -\exp\ (-(\text{the expected number of passengers generated at scanning m at time } t)) \quad (2)$$

P(m,t): call generation probability at scanning m.

Moreover, the situation that the number of passengers generated is small with no car being assigned to any scanning is called an AV state, and the probability of becoming the AV state is calculated by the following equation (3):

$$P(AV,t) = \exp\ (-(\text{the number of all passengers generated at time } t)(3)$$

From the results of the above calculations, a scanning to be assigned to a designated car T-cage is determined. In other words, which floor is served by a car indicated at "cage" is determined. That is, the greatest among all the scanning call generation probabilities P(m,t) and the AV probabilities P(AV,t) is selected.

The above is the scanning assignment procedure in step S303. That is, the scanning which most timely responds to a call generation prediction is selected, or no scanning is selected to carry out any car assignment.

In step S304, it is determined, according to the procedure of step S303, whether the AV state was selected, and when the AV state was selected (in case of "Yes" in step S304), then the control process proceeds to step S305. In step S305, the simulation time point T2(T-cage) of the designated car is advanced just by a prescribed unit time (for instance, one second), and the control process returns to step S301 where a new designated car is selected.

Moreover, when any one of the scannings is selected (in case of "No" in step S304), the procedures in step S306 and thereafter are executed.

In step S306, the stop determining section 1FB determines the floor at which the car is first stopped with respect to the assigned scanning, i.e., scanning starting floor Fs. In other words, the floor at which the car first stops is predicted from among the floors to be served which were determined by the scanning. Therefore, the number of passengers generated at current time t at each the floors which can be served from the current position of the car and which exist within the assigned scanning is calculated by the following equation (4), and the stop probability at each of those floors is also calculated based on the thus calculated number of passengers by using the following equation (5).

$$\text{(the number of passengers at an } F \text{ floor at time } t) = \Sigma_j \text{od-pass-rate}(i,j) \times \text{M-OD-Map}(m,i,j) \times tx(i,j,t) \quad (4)$$

$$\text{(the stop probability at an i floor at time } t) = 1\text{-exp}\ (-(\text{the number of passengers at an } i \text{ floor at time } t)) \quad (5)$$

Then, by sequentially using random numbers from a first scanning floor, the first i floor is determined which satisfies the following inequality (6), and the first i floor is assumed to be the scanning starting floor Fs.

$$\text{(random numbers of 0–1)} < \text{(the stop probability at an } i \text{ floor at time } t) \quad (6)$$

In step S307, a running time of the car required to run from the current car position to the scanning starting floor obtained in step S306 is calculated. The running time can be calculated from the running speed of the car, the height of the current car position and the height of the scanning starting floor. Moreover, the position of a designated car is assumed to be a scanning starting floor, and the next simulation time point T2(T-cage)next of this car is calculated by the following equation.

$$T2(T\text{-cage})\text{next} = T2(T\text{-cage})\text{current} + \text{the running time.}$$

This procedure is carried out by the time control section 1FE.

In step S308, the getting-on processing initialization at the scanning starting floor Fs is done. Concretely, for an initial state of scanning starting. the number of passengers in the designated car and a load factor in the designated car are set to zero, respectively. Further, the expected number of passengers getting on the car at the scanning starting floor Fs is calculated according to the same procedure as in step S306.

In step S309, the getting-on processing at the scanning starting floor Fs is performed based on the expected number of getting-on passengers calculated in step S306. First, the number of passengers in the designated car is set to the expected number of getting-on passengers. Then, a passengers' target floor from the scanning starting floor Fs and the number of passengers moving from the scanning starting floor Fs to the passengers' target floor are set according to the following procedures.

When the expected number of passengers≦1.0:

(a) The expected number of passengers going from an Fs floor to a j floor is calculated based on the formula of step S306, and the j floor having the greatest expected number of passengers is set to the passengers' target floor from the Fs floor. The number of passengers moving to the j floor is set to the expected number of getting-on passengers.

When (the expected number of getting-on passengers at the Fs floor)≦1.0:

(b) The j floor having the largest expected number of passengers going from the Fs floor to the j floor is set to the passengers' target floor from the Fs floor, and the value of the j floor (i.e., the expected number of passengers going from the Fs floor to the j floor) is reduced by 1. In addition, the expected number of passengers getting on at the scanning starting floor Fs is reduced by 1, and the number of passengers moving to the j floor is set to 1.

(c) The procedure of (b) above is repeated until the expected number of passengers getting on at the scanning starting floor Fs becomes 1.0 or less. When the expected number of getting-on passengers becomes 1.0 or less, the procedure of (a) above is carried out.

The above-mentioned steps S308 and S309 are carried out by the getting-on and getting-off processing section 1FC.

The statistical processing section 1FD assumes that a waiting time for each passenger is equal to a half of the period of time from the instant when any of the cars last stopped or passed the Fs floor to the current simulation time point T2 (T-cage), and it sets the waiting time as such.

In addition, the time control section 1FE sets the simulation time point of the designated car according to the following equation (7).

$$T2\ (T\text{-cage})=T2\ (T\text{-cage})+(\text{getting-on time per person})\times(\text{number of getting-on passengers})+(\text{door opening/closing time}) \quad (7)$$

In equation (7) above, the getting-on time per person, which is the time required for a passenger to get on a car, may be properly set according to the type of a building (e.g., 0.8 seconds/per person for an office building).

In step S310, the next floor is set. Where the current position of the designated car is at a F floor, the next floor is set according to the following procedures.

In the UP direction: F=F+1 . . . for UP scanning.

In the DN direction: F=F−1 . . . for DN scanning.

When the set floor F is not a floor which can be served, the floor to be set is advanced while repeating the above-mentioned procedures. Moreover, when the set floor F exceeds an uppermost floor (in the UP direction) or a lowermost floor (in the DN direction), it is determined in step S311 that the scanning ends, and the control process returns to step S301. Otherwise, the procedures of step S312 and thereafter are done. These steps S310 and S311 are performed by the time control section 1FE.

In step S312, the stop determining section 1FB determines whether the designated car is to be stopped at the F floor which was designated in step S310 (i.e., stop for getting off and/or stop for getting on).

To this end, a temporary time T2-tmp represented by the following equation (8) is first calculated.

$$T2\text{-tmp}=T2\ (T\text{-cage})+(\text{running time from the floor at which the designated car stopped last time}) \quad (8)$$

The temporary time T2-tmp means an arrival time at which the designated car will arrive at the F floor when it is assumed that the car stops at the F floor.

A getting-off determination is done by using the above-mentioned temporary time. That is, when the F floor is designated as the target floor of a passenger who got on the car at a floor before or below the F floor during the scanning, it is determined that the passenger gets off the car at the F floor, and otherwise, it is determined that the passenger does not get off the car at the F floor.

Subsequently, a getting-on determination is made. To this end, a stop probability at the F floor is first calculated by using the following equation (9).

$$(\text{the number of getting-on passengers generated at the } F \text{ floor at time } T2\text{-tmp})=\Sigma j\ \text{od-pass-rate}(F,j)\times\text{M-OD-Map}(m,F,j)\times tx(F,j,T2\text{-tmp}) \quad (9)$$

$$(F \text{ floor stop probability at time } T2\text{-tmp})=1-\exp(-(\text{the number of passengers generated at } F \text{ floor at time } T2\text{-tmp})) \quad (10)$$

When the following inequality (11) is satisfied by using random numbers, it is determined that there exists a passenger(s) getting on the car at the F floor, and otherwise, it is determined that there is no passenger getting on the car at the F floor.

$$(\text{random numbers of } 0\text{–}1)<(F \text{ floor stop probability at time } T2\text{-tmp}) \quad (11)$$

When a getting-off determination or a getting-on determination is made according to the above-mentioned procedures, the time control section 1FE sets a simulation time point of the designated car while using the following equation (12).

$$T2\ (T\text{-cage})=T2\ (T\text{-cage})+(\text{running time from the last stop floor})+(\text{door open time}) \quad (12)$$

Subsequently, in step S312, a stop determination is made, and the procedures in step S313 and thereafter are carried out. On the other hand, if neither a getting-on determination nor a getting-off determination is made, it is determined in step S312 that no stop is to be made at the F floor, and the control process returns to step S310.

When a getting-off determination is made in step S312, the getting-on and getting-off processing section 1FC performs getting-off processing in step S313. The procedures for the getting-off processing are achieved by calculating the following equations (13) and (14).

Update of the number of passengers in the car:

$$(\text{the number of passengers in the car})=(\text{the number of passengers in the car})-(\text{the number of passengers who got off the car}) \quad (13)$$

Update of car time $$T2(T\text{-cage})=T2(T\text{-cage})+(\text{getting-off time per passenger})\times(\text{the number of getting-off passengers}) \quad (14)$$

Also, the statistical processing section 1FD sets a service completion time for each getting-off passenger according to the following equation (15).

$$\text{Service completion time}=\text{waiting time}+(\text{current time } T2(T\text{-cage})-\text{getting-on time at the floor at which passengers get on the car}) \quad (15)$$

Here, note that even when a stop determination is made in step S312, if it is determined in step S311 that there is no passenger getting off the car, the step S313 is omitted or skipped so that the control process proceeds to step S314.

When it is determined in step S312 that there is no passenger getting on the car, then in step S314, the time control section 1FE sets the simulation time of the designated car according to the following equation (16), and a return is performed to step S310.

$$T2(T\text{-cage})=T2(T\text{-cage})+(\text{door close time}) \quad (16)$$

When a getting-on determination is made in step S312, the getting-on and getting-off processing section 1FC performs getting-on processing in step S314. This procedure is achieved by the calculations of the number of passengers in the car, a target floor of passengers and the number of passengers moving to the target floor according to the same procedure as in step S309.

Moreover, the statistical processing section 1FD calculates the waiting time for each getting-on passenger according to the same procedure as in step S309.

In addition, time control section 1FE sets the simulation time of the designated car according to the following equation (17).

$$T2(T\text{-cage})=T2(T\text{-cage})+(\text{getting-on time per passenger})\times(\text{the number of getting-on passengers})+(\text{door close time}) \quad (17)$$

Thereafter, a return is performed to step S310.

When it is determined in step S302 that the simulation ends, the statistical processing section 1FD performs statistical processing in step S320. Specifically, an average value, a maximum value, distribution, etc., of waiting times and service completion times for the respective passengers calculated according to the above-mentioned procedures are calculated and output as the results of performance prediction.

In the foregoing, there have been shown and described the simulation procedures in the elevator group supervisory control system according to the present invention.

As described above, according to the present invention, an elevator group supervisory control system for controlling a plurality of elevators as a group, includes: a traffic condition detecting section for detecting a current traffic condition of the plurality of elevators; a rule base for storing a plurality of control rule sets required for group supervisory control; a real time simulating section for simulating the behavior of each car in real time by assigning scanning to each car which is caused to run until the direction of running thereof is reversed while applying a specified rule set in the rule base to the current traffic condition, and for predicting group supervisory control performance which is obtained upon application of the specified rule set; a rule set selecting section for selecting an optimal rule set in response to the results of prediction of the real time simulating section; and an operation control section for controlling an operation of each car based on the rule set selected by the rule set selecting section. With this configuration, a real time simulation can be carried out during a group supervisory control operation, so that the optimal rule set can always be adopted to perform excellent group supervisory control.

Moreover, the above-mentioned real time simulating section includes: a scanning assignment determining section for determining timing at which each car is caused to run and a response floor during simulation, and for performing scanning assignment to each car; a stop determining section for performing a stop determination for each car during scanning running thereof; a getting-on and getting-off processing section for performing getting-on and getting-off processing upon stoppage of each car; a statistical processing section for performing statistical processing such as waiting time distribution after completion of the simulation; and a time control section for controlling simulation time. With the above configuration, the time of calculations can be greatly shortened as compared with a simulation which is performed in terms of each call while using a so-called group supervisory control simulation technique (i.e., a simulation in which simulating operations or calculations are carried out using a plurality of patterns for each call). As a result, a real time simulation can be executed during a group supervisory control operation.

INDUSTRIAL APPLICABILITY

The present invention prepares a rule base storing a plurality of control rule sets, simulates the behavior of each car in real time by assigning scanning to each car which is caused to run until the direction of running thereof is reversed while applying a specified rule set in the rule base to the current traffic condition, and predicts group supervisory control performance which is obtained upon application of the specified rule set. In response to the results of performance prediction, an optimal rule set is selected and a real time simulation can be carried out during a group supervisory control operation, so that group supervisory control can be performed on a plurality of elevators while applying thereto the optimal rule set at all times, thus providing excellent service.

What is claimed is:

1. An elevator group supervisory control system for controlling a plurality of elevators as a group, said system comprising:

a traffic condition detecting section for detecting a current traffic condition of the plurality of elevator cars;

a rule base for storing a plurality of control rule sets required for group supervisory control of the plurality of elevator cars;

a real time simulating section for simulating operation of each elevator car in real time by assigning a scanning movement in a single direction to each elevator car, until the direction of movement of the elevator car is reversed, while applying a specified rule set for the rule base to the current traffic condition, and for predicting group supervisory control performance obtained upon application of the specified rule set;

a rule set selecting section for selecting an optimal rule set in response to the predicting by said real time simulating section; and an operation control section for controlling operation of each elevator car based on the rule set selected by said rule set selecting section.

2. The elevator group supervisory control system as set forth in claim 1, wherein said real time simulating section comprises:

a scanning assignment determining section for determining timing at which each elevator car is caused to move and a response floor during simulation, and for making a scanning assignment to each elevator car;

a stop determining section for making a stop determination for each elevator car during scanning;

a getting-on and getting-off processing section for getting-on and getting-off processing based upon stoppage of each elevator car;

a statistical processing section for statistical processing, such as waiting time distribution after completion of the simulation; and a time control section for controlling simulation time.

* * * * *